US007210486B2

(12) United States Patent
Hartmann

(10) Patent No.: US 7,210,486 B2
(45) Date of Patent: May 1, 2007

(54) PROCESS AND DEVICE FOR CONVEYING A WRAPPER STRIP IN A MACHINE OF THE TOBACCO PROCESSING INDUSTRY

(75) Inventor: Franz Hartmann, Geesthacht (DE)

(73) Assignee: Hauni Maschinenbau AG, Hamburg (DE)

( * ) Notice: Subject to any disclaimer, the term of this patent is extended or adjusted under 35 U.S.C. 154(b) by 438 days.

(21) Appl. No.: 10/355,005

(22) Filed: Jan. 31, 2003

(65) Prior Publication Data

US 2003/0145866 A1 Aug. 7, 2003

(30) Foreign Application Priority Data

Feb. 7, 2002 (DE) ..... 102 05 055

(51) Int. Cl.
*A00C 5/14* (2006.01)

(52) U.S. Cl. ..... 131/60; 131/59; 242/554

(58) Field of Classification Search ..... 131/33, 131/58, 59, 60; 156/497, 504; 242/554; 226/95, 97.1, 1, 7
See application file for complete search history.

(56) References Cited

U.S. PATENT DOCUMENTS 4,081,312 A 3/1978 Cristiani
4,371,418 A * 2/1983 Krywiczanin et al. ..... 158/497
4,485,981 A * 12/1984 Krywiczanin et al. ..... 242/559
4,553,712 A * 11/1985 Krywiczanin et al. ..... 242/554
4,648,409 A 3/1987 Mattei
4,716,909 A 1/1988 Belvederi et al.
4,901,740 A * 2/1990 Heitmann ..... 131/280
5,361,783 A 11/1994 Herburg

FOREIGN PATENT DOCUMENTS

| | | |
|---|---|---|
| DE | 3600321 | 7/1986 |
| EP | 595118 | 5/1994 |
| IT | 1300026 | 5/1998 |
| WO | 0071332 | 11/2000 |

* cited by examiner

*Primary Examiner*—Dionne W. Mayes
(74) *Attorney, Agent, or Firm*—Greenblum & Berstein, P.L.C.

(57) ABSTRACT

Process and apparatus for operating a machine of the tobacco processing industry. The process includes guiding at least one wrapper strip along a conveyor path from a wrapping strip supply to a garniture device, and fixing the at least one wrapper strip in at least one preset position along the conveyor path The instant abstract is neither intended to define the invention disclosed in this specification nor intended to limit the scope of the invention in any way.

2 Claims, 4 Drawing Sheets

PROCESS AND DEVICE FOR CONVEYING A WRAPPER STRIP IN A MACHINE OF THE TOBACCO PROCESSING INDUSTRY

CROSS-REFERENCE TO RELATED APPLICATIONS

The present application claims priority under 35 U.S.C. §119 of German Patent Application No. 102 05 055.4, filed on Feb. 7, 2002, the disclosure of which is expressly incorporated by reference herein in its entirety.

BACKGROUND OF THE INVENTION

1. Field of the Invention

The invention relates to a process for operating a machine of the tobacco processing industry.

The invention also relates to a device for feeding at least one wrapper strip to a feed element that feeds the at least one wrapper snip to a rod of smokeable material or filter maternal of the tobacco processing industry, whereby the device comprises at least one cutting element severing the at least one wrapper strip.

The invention further relates to a process for returning to service a rod machine, whereby at least one wrapper strip is fed to at least one rod of smokeable material or filter material of the tobacco processing industry. The rod is conveyed by a rod conveyor and fed to at least one conveyor element carrying the at least one wrapper strip, whereby rod and wrapper strip are conveyed to a garniture for the continuous wrapping of the rod with the wrapper strip. The invention further relates to a process for emptying a rod machine, in particular a cigarette rod machine or a filter rod machine, such that a wrapper strip for wrapping a rod of smokeable material or filter material of the tobacco processing industry, located in a corresponding device or feed device, is at least partially removed, 2. Discussion of Background Information A paper web feed device for a machine for producing cigarettes is known from DE 36 00 321 C2, which corresponds to U.S. Pat. No. 4,649,409. A suction roller is hereby provided for conveying at least one paper web to a garniture belt. Using an actuator device, on which a Wife is provided, it is possible to sever the paper web at the point where, after a start up of the cigarette production machine, the pressure applied to the cigarette paper is no longer defective. With this device a so-called startup wastage or spoilage is therefore eliminated during return to service. On the return to service or restarting of the cigarette production machine a manual action is necessary to thread the paper web after a machine stoppage.

With cigarette rod production or filter rod production, the problem can nevertheless occur that wrapping paper remains in the machine at the end of tho production of cigarette rods or filter rods, so that this has to be removed afterwards before start up or return to service. Furthermore, in the event of a tear of the wrapper strip and in the case of an initial start up of the rod machine it is necessary to manually feed the wrapper strip to a feed element, so that the wrapper strip is conveyed to a garniture belt and ultimately to a garniture. After an interruption in operation a manual feed is also necessary in the cited DE 36 00 321 C2.

This takes a relatively long time and is disruptive, in particular with two-rod machines, and also leads to faulty cigarettes rods or filter rods. In particular operational stoppages must be considered here, after which the wrapper strips regularly have to be threaded in corresponding elements. Furthermore, it is disadvantageous that in the event of an unintended tear in the wrapper strip, an undefined wrapper strip length can remain in the machine in the event of a stoppage.

SUMMARY OF THE INVENTION

The present invention provides a process for operating a machine of the tobacco processing industry which renders possible a reduction of the startup wastage after a machine is stopped.

Further, the invention provides a device for feeding at least one wrapper strip to a feed element such that a reliable operation is ensured after an operational stoppage or a tear in the wrapper strip, in particular in the case of a return to service. The resumption of operation of a rod machine of the tobacco processing industry should occur in particular with little time taken and very reliably. Furthermore, the present invention provides a corresponding process for the return to service of a rod machine and a process for emptying a rod machine, in particular a cigarette rod machine or a filter rod machine of the tobacco processing industry, such that they can be carried out quickly and reliably.

This aspect of the invention is attained through a process for operating a machine of the tobacco processing industry, such that at least one wrapper strip is provided which is used to wrap a rod of smokeable material or filter material In this regard, the at least one wrapper strip is fixed in at least one preset position on its conveyor path from a wrapper strip supply to a garniture device of the machine in order to be subsequently conveyed further from the preset position.

The invention is based on the inventive concept that in order to reduce the startup wastage fixing the wrapper strip supply during a machine stoppage or in the case of a malfunction that when the machine is started up again it can be made available again and conveyed further in a defined manner and without a loss of time due to manual threading of the wrapper snip. According to the invention, this consequently results in an automation of the operation of the machine of the tobacco processing industry, Within the scope of this invention, fixing can also be referred to a holding.

When the fixing is preferably conducted during the stoppage of at least one part of the machine, little wrapper material is used.

Fixing preferably hereby occurs on receipt of a stop signal and/or a malfunction signal. The further conveyance step occurs in an embodiment of the invention during or after the start up of at least one part or the part of the machine that was stopped.

The at least one wrapper strip is preferably fixed in the machine, in particular in a feed device, If the part of the at least one wrapper strip arranged downstream is severed during or after fixing, a defined starting position of the wrapping material can be preset. The part of the at least one wrapper strip arranged downstream is not fixed in one embodiment of the invention. In the latter case it is preferably provided that the part of the wrapper strip arranged downstream from the conveyor path if removed before the fixed part of the wrapper snip is conveyed further, so that still less startup wastage is produced. For further conveyance fixing is then preferably ended.

This further aspect of the invention is achieved with a device to feed at least one wrapper strip to a feed element that feeds the at least one wrapper strip to a rod of smokeable material or filter material of the tobacco processing industry. In this manner, the device can include a cutting element severing the at least one wrapper strip, and the device may be further developed such that a fixing unit is provided, by which one end of the divided wrapper strip can be fixed.

The invention adopts the inventive concept that in the event of an interruption of the rod production the at least one wrapper strip, e.g., a wrapper strip or, in the case of a double-rod machine, two wrapper strips, is severed in a defined way, in order then to fix one part. When lowering the rod machine the remaining and no longer needed wrapper strip part can be safely removed from the machine, whereas on restarting or resuming operation of the rod machine the part of the wrapper strip that was fixed, in particular automatically, which was not removed, can be used for the production of a rod or several rods.

Within the scope of this invention the term fixing unit can also refer to a holding element or holding device.

When one cutting element is provided per wrapper strip in a preferred exemplary embodiment, a very quick-working cutting element can be provided. The cutting element is preferably a knife. In an alternative embodiment the cutting element can also be a laser which brings a focused laser beam on the wrapper strip by at least one optical element so that the strip is severed. The focused laser beam can hereby be movable or fanned out as a line.

In a particularly preferred embodiment the fixing unit is contained in the cutting element. To this end, e.g., the knife can be provided with a holding surface so that after cutting the wrapper strip or during the cutting of the wrapper strip the wrapper strip on one end presses with the pressure surface of the knife on another element, e.g., a thrust bearing, so that the wrapper strip is correspondingly held clamped. The fixing unit is preferably a mechanical element, such as, e.g., an element that comprises a corresponding pressure surface. When the fixing unit fines the one end of the severed wrapper strip with suction air, a fixing is possible that can be realized or released very quickly.

The fixing unit is preferably arranged upstream of the cutting element. Through this measure it is particularly easy to remove form the machine the remaining wrapper strip that is no longer needed An arrangement for feeding at least one wrapper strip from at least one wrapper strip supply to at least one rod of smokeable material or filter material of the tobacco processing industry with at least one rod conveyor for conveying and transferring the rod to at least one conveyor element conveying, in particular carrying, the at least one wrapper strip, which conveyor element conveys the rod and wrapper strip to a garniture for the continuous wrapping of the rod with the wrapper strip, is preferably further developed in that a device of the type according to the invention or a device according to a preferred embodiment of the invention is provided between the at least one wrapper strip supply and the conveyor element.

furthermore, a rod machines in particular a filter rod machine or cigarette rod machine with at least one device according to the invention or with an arrangement according to the invention as described above, is preferably provided.

The present invention provides a process for returning to service a rod machine, whereby at least one wrapper strip is fed to at least one rod of smokeable material or filter material of the tobacco processing industry. In this manner, the rod is conveyed by a rod conveyor and fed to at least one conveyor element carrying or conveying the at least one wrapper strip, such that rod and wrapper strip are conveyed to a garniture for the continuous wrapping of the rod with the wrapper strip and whereby the feeding of the at least one wrapper strip occurs automatically.

Within the scope of this invention, feeding of the at least one wrapper strip refers to in particular the transport of one end or beginning of the wrapper strip from a wrapper strip supply to the rod of smokeable material or the corresponding transport of the severed part of a wrapper strip. In particular, this refers a feeding to the rod for return to service of the rod machine. Within the scope of this invention, automatic means completely or exclusively automatic. Within the scope of this invention the expression return to service also means start up.

The automatic feed preferably occurs after a loosening of a fixing unit fixing the at least one wrapper strip at least at one end and thus after a release of the at least one wrapper strip. With this preferable embodiment of the process according to the invention, it is assumed that, in the event of a stoppage of the rod machine, a fixing unit is provided in order to fix a wrapper strip so that later upon return to service of the machine it can automatically be fed to the machine again. The fixing unit, which can be in particular a retaining element, hereby holds the wrapper strip in a preset position. The feeding preferably occurs by a transporting air flow flowing in the feed direction. A particularly simple method of feeding is provided by this preferred embodiment of the process according to the invention. If the wrapper strip is arranged on a bobbin as a wrapper strip supply, the bobbin is driven so as not to require too great a tensile force or feed force by which the wrapper strip is fed towards the rod.

The present invention also provides a process for emptying a rod machine, in particular a cigarette rod machine or a filter rod machine, whereby a wrapper strip for wrapping a rod of smokeable material or filter material of the tobacco processing industry located in a feed device is at least partially removed. In this, manner, the wrapper strip is severed in the feed device and whereby a part of the wrapper strip is fixed in the feed device, while the other severed part is removed from the feed device. Through the process according to the invention, it is possible to remove in a defined manner a part of the wrapper strip from the rod machine, so that this part of the wrapper strip does not interfere during a restarting or return to service of the rod machine. Furthermore, it is possible through the process according to the invention to restart the machine in a defined and rapid manner after conducing the process to empty the rod machine, The emptying preferably occurs by a brief further operation of the rod machine and the correlating conveyance of the rod. However, the emptying can also occur by transporting airflow or compressed air.

The process for emptying a rod machine is preferably carried out after receiving a stop signal, This stop signal can be sent, e.g., when there are problems in the suction rod conveyor of a cigarette rod machine, when, e.g., there is too much or too little tobacco on the suction rod conveyor. Furthermore, a stop signal can be produced when a tear of the wrapper strip or a wrapper strip occurs.

When the fixing occurs mechanically, in particular by a fixing unit, a process is possible that is particularly simple to implement. When the fixing occurs by suction air, the process according to the invention can be conducted very quickly and with little wear. The severing is preferably a cutting off.

The invention is further attained through a process for operating a rod machine, whereby a process according to the invention for emptying the rod machine is first used and whereby subsequently a process for returning the rod machine to service, as described above, is used. For the automatic restarting of a rod machine, the wrapper strip is thus hereby stopped in a defined manner and the part of the wrapper strip no longer required is disposed of from the machine, Whereby subsequently in particular the start of the wrapper strip is made available and is conveyed to the rod again.

The present invention is directed to a process for operating a machine of the tobacco processing industry. The process includes guiding at least one wrapper strip along a conveyor path from a wrapping strip supply to a garniture device, and fixing the at least one wrapper strip in at least one preset position along the conveyor path.

According to a feature of the invention, the process can further include wrapping a rod of at least one of a smokeable material and a filter material with the at least one wrapper strip.

In accordance with another feature of the present invention, the fixing of the at least one wrapper strip can occurs during a stoppage of at least one part of the machine.

Moreover, the process can include releasing the at least one wrapper strip from the at least one preset position in which it is fixed, and conveying the at least one wrapper sip from the at least one preset position along the conveyor path The conveying of the at least one wrapper strip occurs either during or after a start up of at least one part of the machine. Further, the conveying may include directing a transporting airflow in a feed direction of the at least one wrapper strip, whereby the at least orb wrapper strip is transported by the directed airflow. A fixing unit can be arranged to fix and subsequently release the at least one wrapper strip) and the conveying may occur after the subsequent release of the at least one wrapper strip by the fixing unit.

According to still another feature, the machine can include a feed device, through which the conveyor path extends, and the at least one wrapper strip may be fixed in a feed device of the machine.

The process can also include severing the at least one wrapper strip in a region of the preset position either during or after the fixing of the at least one wrapper strip, The severing of the at least one wrapper strip can form a fixed portion of the at least one wrapper strip and a downstream portion of the at least one wrapper strip located downstream of the fixed portion, relative to a conveyor path direction. Further, the process can include removing the downstream portion of the at least one wrapper strip from the conveyor path, and conveying the fixed portion of the at least one wrapper strip subsequent to the removal of the downstream piston, In accordance with another feature of the instant invention, the fixing of the at least one wrapper strip may include holding the at least one wrapper strip in place in the region of the preset position with a mechanical device. The mechanical device can include a cylinder/piston device, and the mechanical device can clamp the at least one wrapper strip in place in the region of the preset position. Further, the mechanical device may include a piston having a pressure surface arranged to move against a trust beaming biased by a spring. Also, a cutting edge can be coupled to the piston.

In accordance with a further feature, the fixing of the at least one wrapper strip may include holding the at least one wrapper strip in place in the region of the preset position via suction air.

Still further, the process may include severing of the at least one wrapper strip with a cutting device. In this regard, the cutting device can include a knife. Alternatively, the cutting device can include an optical cutter. The optical cutter can be a laser.

The present invention is directed to a process for returning a rod machine of the tobacco processing industry to service. The machine includes a rod conveyor arranged to convey at least one rod of smokeable material or of filter material, a feed element and a garniture. Subsequent to a service stoppage of at least a part of the machine, the process include automatically feeding a leading edge of the at least one wrapper strip to the feed element, transferring the at least one rod onto the at least one wrapper strip in a region of the feed device, guiding the at least one rod and the at least one wrapper strip to the garniture, and continuously wrapping the at least one rod with the at least one wrapper strip.

In accordance with an aspect of the invention, the feeding can include directing a transporting airflow in a feed direction of the at least one wrapper strip, whereby the at least one wrapper strip is transported by the directed airflow, Further, a fixing unit can be arranged to fix and subsequently release the at least one wrapper strip, and the automatic feeding may occur after the subsequent release of the at least one wrapper strip by the fixing unit.

The instant invention is directed to a process for the automatic start up of a rod machine of the tobacco processing industry. The machine includes a rod conveyor arranged to convey at least one rod of smokeable material or of filter material, a feed element, and a garniture The process includes automatically feeding a leading edge of the at least one wrapper strip to the feed element, transferring the at least one rod onto The at least one wrapper strip in a region of the feed element, guiding the at least one rod and the at least one wrapper strip to the garniture, and continuously wrapping the at least one rod with the at least one wrapper strip.

The instant invention is also directed to a process for emptying a rod machine of the tobacco processing industry, that includes guiding at least one wrapper strip for wrapping a rod of smokeable material or of filter material through a feed device, severing the at least one wrapper strip in the feed device, thereby forming a first and a second wrapper strip, positionally fixing the first wrapper strip in the feed device, and removing the second wrapper strip from the feed device.

In accordance with all aspect of the invention, the rod machine may be one of a cigarette rod machine or filter rod machine.

Further, the fixing of the first wrapper strip can include holding the first wrapper strip in place in the feed device with a mechanical device. The mechanical device may include a cylinder/piston device, and the mechanical device can clamp the first wrapper strip in place in the feed device. The mechanical device can include a piston having a pressure surface arranged to move against a trust bearing biased by a spring. A cutting edge can be coupled to the piston.

According to another aspect of the invention, the fixing of the first wrapper strip can include holding the first wrapper strip in place in the feed device via suction air.

Further, the severing of the at least one wrapper strip may include comprises cutting the at least one wrapper strip with a cutting device. The cutting device comprises a knife or an optical cutter, such as a laser.

The process can further, include releasing the first wrapper strip, and automatically feeding the first wrapper strip by directing a transporting airflow in a feed direction of the at least one wrapper strip, whereby the at least one wrapper strip is transported by the directed airflow.

Further, a fixing unit can be arranged to fix and subsequently release the at least one wrapper strip in the feed device, and automatic feeding may occur after the subsequent release of the at least one wrapper strip by the fixing unit.

The present invention is directed to a process for operating a rod machine of the tobacco processing industry, that includes guiding at least one wrapper strip for wrapping a rod of smokeable material or of filter material through a feed device, transferring the at least one rod onto the at least one wrapper strip in a region of the feed element, and guiding the at least one rod and the at least one wrapper strip to a garniture, such that the at least one rod is continuously wrapped with the at least one wrapper strip. Upon a stoppage in at least a part of the machine, the process further includes severing the at least one wrapper strip in t feed device, thereby forming a first and a second wrapper strip, positionally fixing the first wrapper strip in the feed device, and removing the second wrapper strip from the feed device, releasing the first wrapper strip, automatically feeding a leading edge of the first wrapper strip to the feed element, transferring the at least one rod onto the at least one wrapper strip in a region of the feed element, guiding the at least one rod and the at least one wrapper strip to the garniture, and continuously wrapping the at least one rod with the at least one wrapper strip.

The instant invention is directed to a feed device for feeding at least one wrapper strip to a feed element that feeds the at least one wrapper strip to a rod of smokeable material or of further material of the tobacco processing industry. The feed device includes a cutting element arranged to sever the at least one wrapper strip, and a fixing unit structured and arranged to positionally fix one end of the severed wrapper strip.

According to a feature of the invention, the at least one wrapper strip may include a plurality of wrapper strips, and the cutting element can include one cutting element per wrapper strip.

In accordance with another feature, the cutting element can be a knife. Further, the cutting element can include the fixing unit.

Still further, the fixing a unit can include a mechanical element structured and ranged to clamp the one end of tile severed wrapper strip. Moreover, the fixing unit may include a suction device structured and arranged to suction the one end of the severed wrapper strip. The fixing unit is arranged upstream of the cutting element, relative to a wrapper travel direction.

In accordance with still another feature of the instant invention, a transporting airflow supply can be structured and arranged to blow air in a feed direction of the at least one wrapper strip. The fixing unit may be structured and arranged to release the at least one wrapper snip subsequently to the fixing, and, after the subsequent release of the at least one wrapper strip by the fixing unit, the transporting airflow supply can blow the air in order to automatically feed the at least one wrapper strip, According to a further feature of the present invention, a base body and a lid may be structured and arranged to form a feed channel, through which the at least one wrapper ship is guided Further, a flap can be arranged upstream of the base body and on a same side of the at least one wrapper strip as the basic body. Moreover, transporting airflow nozzles can be located within the flap and the lid, and the transporting airflow nozzles may be directed to feed the at least one wrapper strip through the feed channel The present invention is directed to an apparatus that includes the above-discussed feed device and further includes at least one wrapper strip supply sturctured and arranged to supply the at least one wrapper strip, a garniture, a conveyor element arranged to guide the at least one rod and the at least one wrapper strip, and a device for feeding the at least one wrapper strip from the at least one wrapper strip supply to the conveyor element. The feed device is located between the at least one wrapper strip supply and the conveyor element.

According to an aspect of the instant invention, an air supply can be arranged to direct air in a transport direction of the at least one wrapper strip. Further, subsequent to a stoppage in the apparatus, the air supply can be utilized to automatically feed the at least one wrapper strip from the at least one wrapper strip supply to the conveyor element.

In accordance with still yet another feature of the present invention, an actuation device may be coupled to the cutting element, such that, in the event of a stoppage in the apparatus, the actuation device actuates the cutting element. The actuation device can also be arranged to actuate the fixing device to positionally hold the one end of the at least one wrapper strip. The actuation device can also structured and arranged to release the one end of the at least one wrapper strip, whereby the air directed by the air supply threads the at least one wrapper strip.

The present invention is directed to a rod machine comprising the above-discussed feed device in which the rod machine is structured and arranged as at least one of a filter rod machine or cigarette rod machine.

The instant invention is also directed to a rod machine that includes the above-discussed apparatus in which the rod machine is structured and arranged as at least one of a filter rod machine or cigarette rod machine.

Other exemplary embodiments and advantages of the present invention may be ascertained by reviewing the present disclosure and the accompanying drawing.

BRIEF DESCRIPTION OF THE DRAWINGS

The present invention is further described in the detailed description which follows, in reference to the noted plurality of drawings by way of non-limiting examples of exemplary embodiments of the present invention, in which like reference numerals represent similar parts throughout the several views of the drawings, and wherein.

DETAILED DESCRIPTION OF THE PRESENT INVENTION

The particulars shown herein are by way of example and for purposes of illustrative discussion of the embodiments of the present invention only and are presented in the cause of providing what is believed to be the most useful and readily understood description of the principles and conceptual aspects of the present invention. In this regard, no attempt is made to show structural details of the present invention in more derail than is necessary for the fundamental understanding of the present invention, the description taken with the drawings making apparent to those skilled in the art how the several forks of the present invention may be embodied in practice.

In the following figures the same elements are labeled with the same reference numbers, so that there is no need for a new introduction each time.

Figure 1:
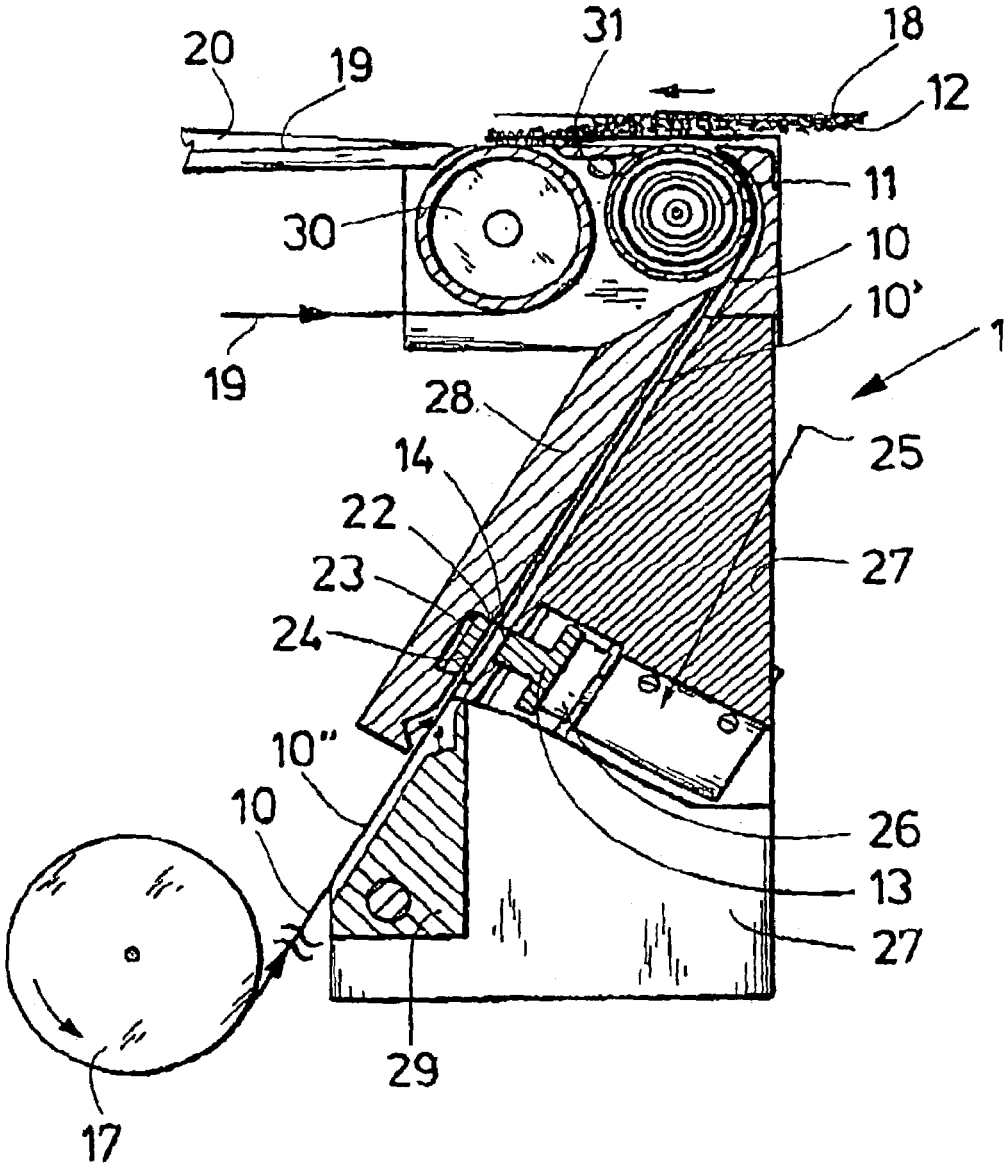
FIG. 1 illustrates a sectional side view of a part of a cigarette rod machine in which the process is performed.

FIG. 1 shows a part of a cigarette rod machine in a diagrammatic representation, whereby some parts are shown in section in a side view, The par of the rod machine which is shown in FIG. 1 comprises in particular a for device 1 by which a wrapper strip 10 in the form of a cigarette paper can be fed from a wrapper snip supply 17 in the form of a bobbin first to a feed element 11 in the form of a deflection roller, whereby the wrapper strip 10 is then united with a tobacco rod 12 above a thrust bearing 31, which tobacco rod is conveyed by a rod conveyor belt 18 in FIG. 1 from right to left (in the direction of the arrow). The applicant has obtained patents for an effective advancement of the start of The wrapper strip, namely, e.g., EP 0 595 118 B1, which corresponds to U.S. Pat. No. 5,361,783, and the disclosures of these patents are expressly incorporated by reference herein in their entireties, In order to ensure at a start up or putting into operation of the machine that the start of the wrapper strip 10 downstream of the deflection roller 11 is advanced by the correlating garniture belt 19 and the correlating rod 12, it was proposed in the cited patents to provide a pusher clement that is arranged above the thrust bearing 31, and that can be activated during feeding the start of the wrapper strip to reduce the distance between the rod conveyor belt 18 and the wrapper strip 10. This pusher clement is not shown in the Figures.

After reaching the garniture belt 19 that is guided around the deflection roller 30 and fed to a garniture 20 for the continuous wrapping of the rod 12 with the wrapper strip 10, the frictional force between the garniture belt 19 and the wrapper strip 10 is sufficient to transport it accordingly in continuous operation. The feed device 1 is further embodied in FIG. 1 in a diagrammatic sectional view in side view, namely in the form of a knife 13 that is installed on a fastening plate 26 which can be moved by a pneumatic cylinder 25 with rod guidance in a linear manner crosswise to the conveyor direction of the wrapper strip 10.

Figure 2:
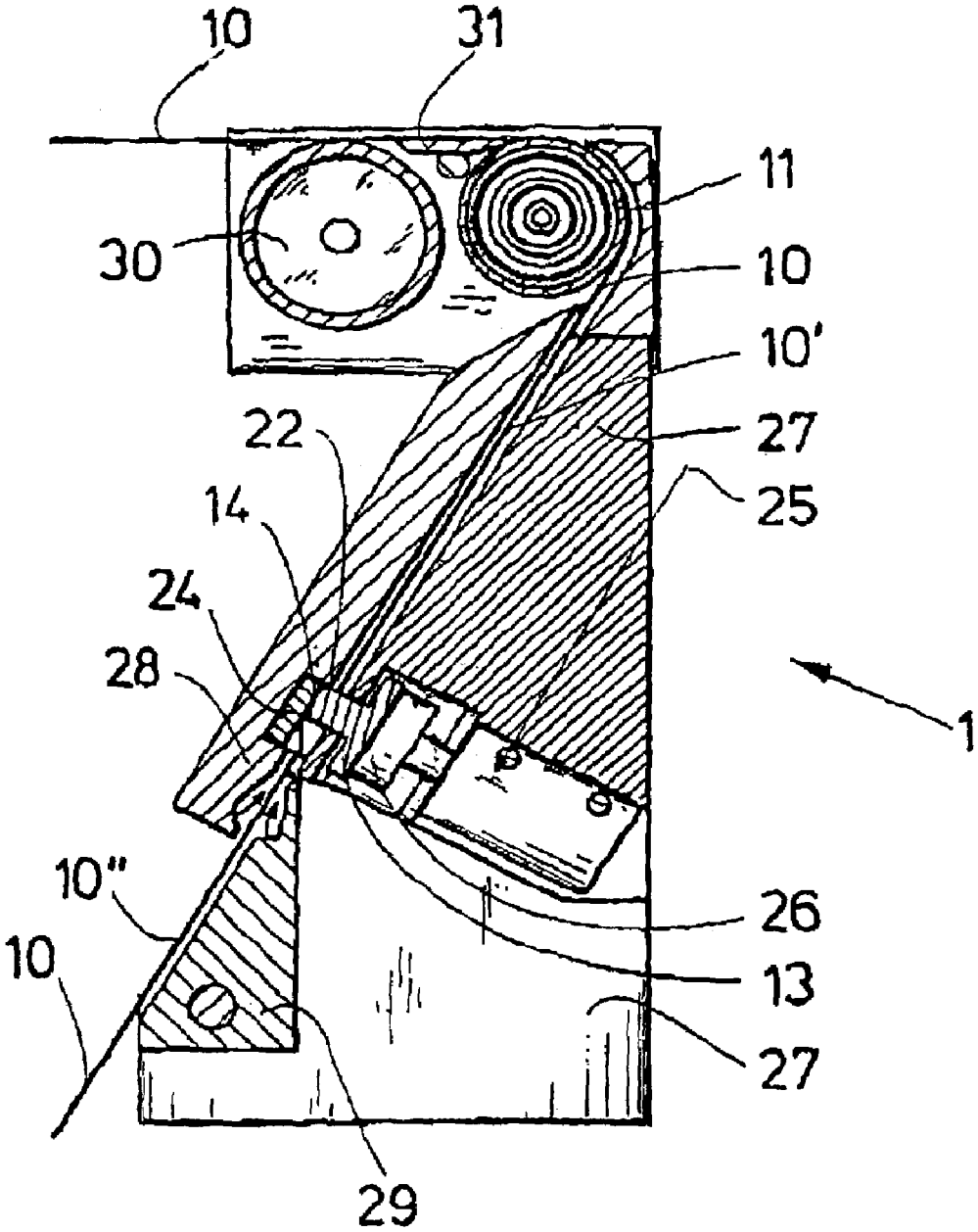
FIG. 2 illustrates a sectional side view of a different process phase in the part of the machine depicted in FIG. 1.

The knife 13 reaches in an effective engagement with a blade edge 22 to cut the wrapper strip 10 as is also shown diagrammatically in FIG. 2. A thrust bearing 24 is further provided which is preloaded with a spring 23 and presses against the pressure surface 14. During cutting the wrapper strip 10 on the blade edge 22, the one end of the wrapper strip 10 is pressed with the pressure surface 14 against one surface of the thrust bearing 24 and thus the wrapper strip 10 is held. Cutting and fixing the one end of the severed wrapper strip 10 occurs, e.g., upon problems with the suction rod conveyor 18.

Figure 3:
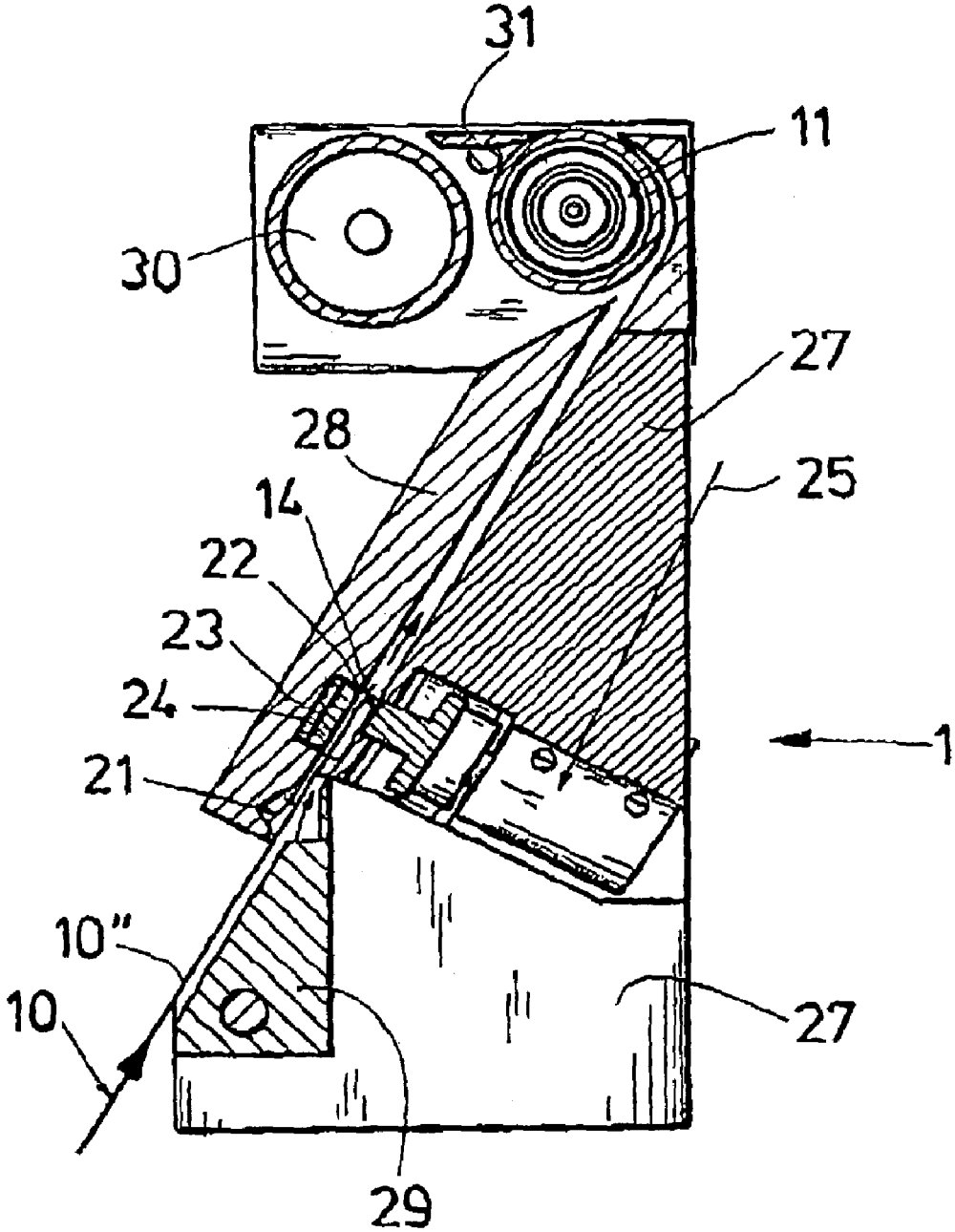
FIG. 3 illustrates a sectional side view of a process phase subsequent to that depicted in FIG. 2.

FIG. 2 shows the feed device 1 in a phase in which the wrapper strip 10 was cut and accordingly one end 10" of the wrapper strip 10 is clamped. Subsequently the upper part 10' of the wrapper strip, i.e., that part that is above the knife 13 or the cutting element 13 that is embodied in this exemplary embodiment as a knife, is transported away. Instead of the knife 13, a laser device 32 with a focusing optical system can also serve as a cutting element 13. Fixing the one end of the wrapper strip 10 is then to be realized in a different manner, such as, e.g., by a fixing unit that corresponds to the fixing unit shown in FIGS. 1 through 3, in which however there is no knife function. However, another fixing unit such as, e.g., shown in FIG. 4, can be available. This fixing unit is described in more detail below.

In the event of a restarting or return to service of the rod machine, on the one hand a transporting airflow 21 is admitted into the channel that is defined by the base body 27 and the lid 28. The transporting airflow 21 is represented diagrammatically by arrows in FIG. 3. The wrapper strip 10 or, before this conveyor step, the upstream part 10' of the wrapper strip 10, is fed or conveyed in the direction of the feed element 11 by this transporting airflow. This can occur fully automatically.

In the case of a first start up of the rod device or in the event of a tear in the wrapper strip upstream of the cutting element or fixing unit, it is necessary to thread the wrapper strip 10 manually into tho channel defined by the lid 28 and the base body 27. To is end a flap 29 is opened, in order to provide a better engagement possibility or threading possibility for the operator.

Figure 4:
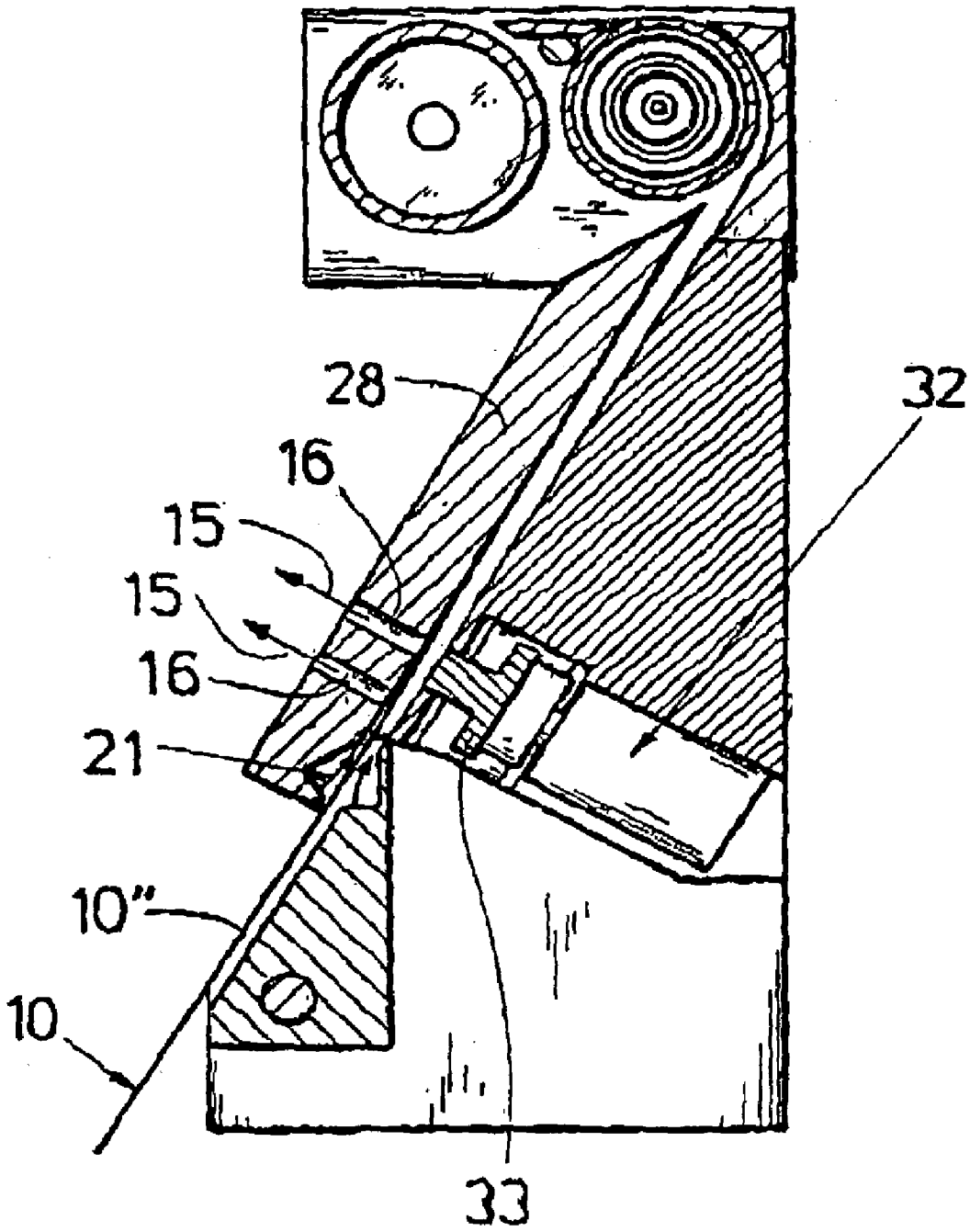
FIG. 4 illustrates a sectional side view of another embodiment of a feed device according to the invention.

FIG. 4 shows another embodiment of the feed device 1 according to the invention in diagrammatic sectional view in side view. To fix the wrapper strip 10, suction air 15 is guided through the suction borings 16 so that a fixing occurs by the suction air. In this exemplary embodiment the cutting element 13 can be a laser device 32 with a focusing optical system 33 or a knife 33, which, however, is not shown in FIG. 4.

The feed device according to the invention is now operated so that a wrapper strip 10 is severed by a cutting element 13, 32, 33 and is axed by a fixing unit 13, 14, 16, 24 in the event of a malfunction or a stoppage of the rod machine. The part of the wrapper strip 10 not fixed is then removed from the machine in that it is moved out of the machine with the garniture belt 19. In the event of a return to service of the rod machine, the fixing is released and the wrapper strip is automatically fed first to a feed element 11, in order to be then united with a cigarette rod 12 or a filter rod, when a feed to a garniture 20 occurs in which the wrapper strip is wrapped around the cigarette rod or the filter rod.

Severing the wrapper strip can occur with both small and large cutting angles. A linear movement or a rotating movement of the cutting element or a combination of the two can occur. In the event of a cutting element comprising a laser device with a focusing optical system, the focused laser beam is rotated or a laser beam produced comprising a focus extended in a linear manner. The fixing of the wrapper strip can occur both by a type of clamping or a vacuum or a suction air or another process both individually and in combination with the cutting. It is further possible to carry out the first threading of the wrapper strip such that the wrapper strip is transported by an airflow into the feed device 1 and there is cut and held in a preparatory position so that with the actual start up or start of operation of the rod machine, an automatic feed of be wrapper strip can occur.

It is noted that the foregoing examples have been provided merely for the purpose of explanation and are in no way to be construed as limiting of the present invention, While the present invention has been described with reference to an exemplary embodiment, it is understood that the words which have been used herein are words of description and illustration, rather than words of limitation. Changes may be made, within the purview of the appended claims, as presently stated and as amended, without departing from the scope and spirit of the present invention in its aspects. Although the present invention has been described herein with reference to particular means, materials and embodiments, the present invention is not intended to be limited to the particulars disclosed herein; rather, the present invention extends to all functionally equivalent structures, methods and uses, such as are within the scope of the appended claims.

LIST OF REFERENCE NUMBERS

1 Feed device
10 Cigarette paper
10' Downstream part of the cigarette paper
10" Upstream part of the cigarette paper
11 Deflection roller
12 Tobacco rod
13 Knife
14 Pressure surface
15 Suction air
16 Suction borings
17 Bobbin
18 Rod conveyor belt
19 Garniture belt
20 Garniture
21 Transporting airflow
22 Blade edge
23 Spring
24 Thrust bearing
25 Pneumatic cylinder with rod guidance
26 Fastening plate
27 Base body
28 Lid
29 Flap
30 Deflection roller
31 Thrust bearing
32 Laser device
33 Focusing optical system

What is claimed is:

1. A process for returning a rod machine of the tobacco processing industry to service or for the automatic start-up of a rod machine of the tobacco processing industry, the machine including a rod conveyor arranged to convey at least one rod of smokeable material or of filter material, a feed device for feeding at least one wrapper strip to a feed element, and a garniture, the process comprises:

automatically feeding a leading edge of the at least one wrapper strip to the feed element;

transferring the at least one rod onto the at least one wrapper strip in a region of the feed device;

guiding the at least one rod and the at least one wrapper strip to the garniture; and continuously wrapping the at least one rod with the at least one wrapper strip, wherein a fixing unit retains the leading edge of the at least one wrapper strip in a preset position within the feed device/rod machine, and subsequently releases the leading edge, and wherein the automatic feeding occurs after the subsequent release of the leading edge by the fixing unit.

2. The process in accordance with claim 1, wherein the feeding comprises directing a transporting airflow in a feed direction of the at least one wrapper strip, whereby the at least one wrapper strip is transported by the directed airflow.

* * * * *